US005443186A

United States Patent [19]

Grill

[11] Patent Number: 5,443,186

[45] Date of Patent: Aug. 22, 1995

[54] FLUID DISPENSER WHICH HAS A BUTTON ACTUATED REGULATOR VALVE AND A PRESSURE RELIEF PORT IN THE BUTTON

[76] Inventor: Benjamin Grill, 9819 Etiwanda Ave., Northridge, Calif. 91329

[21] Appl. No.: 177,665

[22] Filed: Jan. 5, 1994

[51] Int. Cl.[6] ..... B65D 83/00

[52] U.S. Cl. ..... 222/396; 222/399; 222/214; 137/505.11; 137/505.26

[58] Field of Search ..... 222/4, 5, 399, 190, 222/396, 397, 464, 214; 137/505.11, 505.26

[56] References Cited

U.S. PATENT DOCUMENTS 1,056,394 3/1913 Bernard-Schmolle ..... 222/396
3,679,104 7/1972 Giroud ..... 222/396
5,022,565 6/1991 Sturman et al. ..... 222/5 X
5,180,081 1/1993 McCann ..... 222/396 X

*Primary Examiner*—Gregory L. Huson
*Attorney, Agent, or Firm*—Blakely, Sokoloff, Taylor & Zafman

[57] ABSTRACT

A portable soft drink dispenser that can be attached to a conventional beverage container and maintain the carbonation of the beverage. The dispenser includes a housing with an internal thread that can be mated with the external thread of a conventional beverage container. Attached to the housing is a removable $CO_2$ cartridge which can supply $CO_2$ to the beverage container. The flow of $CO_2$ into the container is controlled by a regulator valve that is coupled to a button by a spring. The pressure within the beverage container can be varied by manually pushing the button.

1 Claim, 2 Drawing Sheets

FLUID DISPENSER WHICH HAS A BUTTON ACTUATED REGULATOR VALVE AND A PRESSURE RELIEF PORT IN THE BUTTON

BACKGROUND OF THE INVENTION

1. Field of the Invention

The present invention relates to an attachment which can discharge carbon dioxide into a conventional beverage container.

2. Description of Related Art

Soft drinks are typically carbonated with carbon dioxide ($CO_2$) to improve the taste of the beverage. The soft drink is then bottled in a pressurized sealed container to maintain the drink in the carbonated state. Carbonated soft drinks are frequently sold in two liter plastic bottles which have a resealable top. Removing the top allows the $CO_2$ to flow out of the container. Repeated openings of the top will allow a significant amount of the carbon dioxide to escape, resulting in a soft drink that taste "flat". It is desirable to recharge the soda with a $CO_2$ cartridge or tank to extend the useful life of the soft drink.

U.S. Pat. No. 5,022,565 issued to Sturman et al, discloses a dispenser which can be attached to the top of a beverage container to discharge $CO_2$ into the contents of the container. The Sturman dispenser includes a small removable $CO_2$ cartridge and a pressure regulator which regulates the internal pressure of the container. The dispenser of the '565 patent also contains an outlet tube and a spring loaded lever valve which controls the flow of soda out of the container.

The regulator valve of the Sturman dispenser is constructed so that $CO_2$ flows from the cartridge to the beverage container until the pressure within the container reaches a predetermined level. The container pressure is a fixed value which is set by the area ratio between a valve port and a valve member that controls the movement of the regulator valve. Each beverage container is therefore charged to approximately the same pressure. It would be desirable to provide a soft drink dispenser which would allow the user to vary the pressure level at which the dispenser charges the soft drink with $CO_2$. For example, the user may want to carbonate an uncarbonated drink. Carbonating an uncarbonated soft drink will typically require a greater amount of $CO_2$ and a higher beverage pressure than a soft drink which has lost some of its carbonation.

SUMMARY OF THE INVENTION

The present invention is a portable soft drink dispenser that can be attached to a conventional beverage container and maintain the carbonation of the beverage. The dispenser includes a housing with an internal thread that can be mated with the external thread of a conventional beverage container. Attached to the housing is a removable $CO_2$ cartridge which can supply $CO_2$ to the beverage container. The flow of $CO_2$ into the container is controlled by an automatic regulator valve which insures that at least a minimum pressure is maintained within the container. The regulator valve is connected to a spring biased button. The pressure can be increased above the minimum level by manually depressing the button.

The dispenser also contains a flexible tube which allows the carbonated soft drink to flow out of the container. The flow of soda is controlled by a spring loaded lever which can be rotated by the user between an open position and a closed position.

It is an object of the present invention to provide a soft drink dispenser which allows the user to control the pressure within the beverage container.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
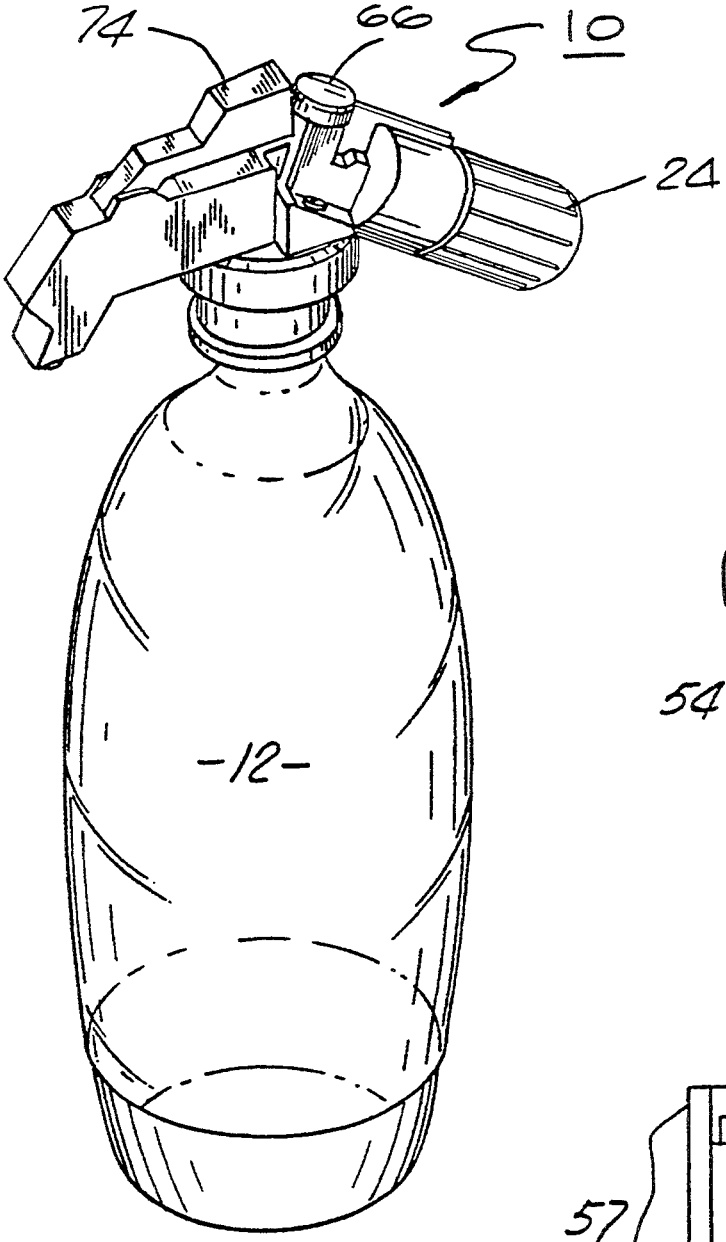
FIG. 1 is a perspective view of a soft drink dispenser of the present invention attached to a beverage container.

Referring to the drawings more particularly by reference numbers, FIG. 1 shows a soft drink dispenser 10 which is attached to a beverage container 12. The beverage container 12 is typically a plastic PET bottle which is both light and disposable. Although a plastic PET bottle is shown and described, it is to be understood that the dispenser can be used with other types of beverage containers 12. The container may contain a beverage which is either carbonated or uncarbonated.

The dispenser 10 includes a housing 14 which has a first internal thread 16 which can be screwed onto an external thread 18 of the beverage container 12. Adjacent to the internal thread is an O-ring 20 which seals the container to the housing 14. The housing 14 has a second internal thread 22 which is adapted to receive a cartridge housing 24. The cartridge housing 24 has a cartridge 26 which contains pressurized $CO_2$.

The housing 14 has a regulator seat insert 28 pressed into a brass insert 30. The seat 28 is sealed to the insert by O-ring 32. Pressed into the seat 28 is a sintered metal member 34 which filters out any impurities introduced to the dispenser 10 by the $CO_2$ cartridge. Adjacent to the metal member 34 is a needle 36 which is adapted to puncture the gasket of cartridge 26 to allow $CO_2$ to flow into the dispenser 10. The needle 34 is held in place by a cap screw 38 which is screwed into the insert 30.

The housing 22 has an internal passage 40 which provided fluid communication between the needle 36 and the beverage container 12. The passage 40 has an outlet port 42 which is located in an annular flange 44. Attached to the annular flange 44 is an elastic band 46 that covers the port 42. The elastic band 46 functions as a one-way valve which allows $CO_2$ to flow from the dispenser 10 into the beverage container 12, but does not allow fluid to flow from the beverage container 12 into dispenser 10.

Located within a regulator valve chamber 48 of the housing 14 is a regulator valve 50. The regulator valve 50 is normally seated against a seat 52. The valve 50 is adapted to move between a closed position and an opened position. The valve 50 allows $CO_2$ to flow into the beverage container when in the open position and prevents the flow of $CO_2$ when in the closed position.

Figure 3:
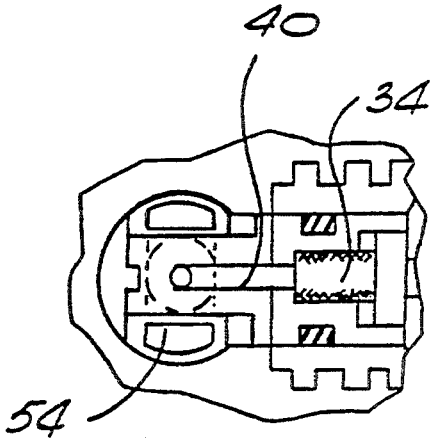
FIG. 3 is a top sectional view of a regulator valve of the dispenser.
Figure 4:
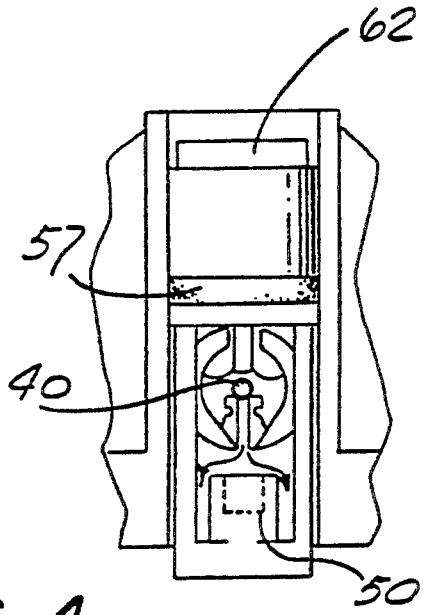
FIG. 4 is a side sectional view of the regulator valve.
Figure 2:
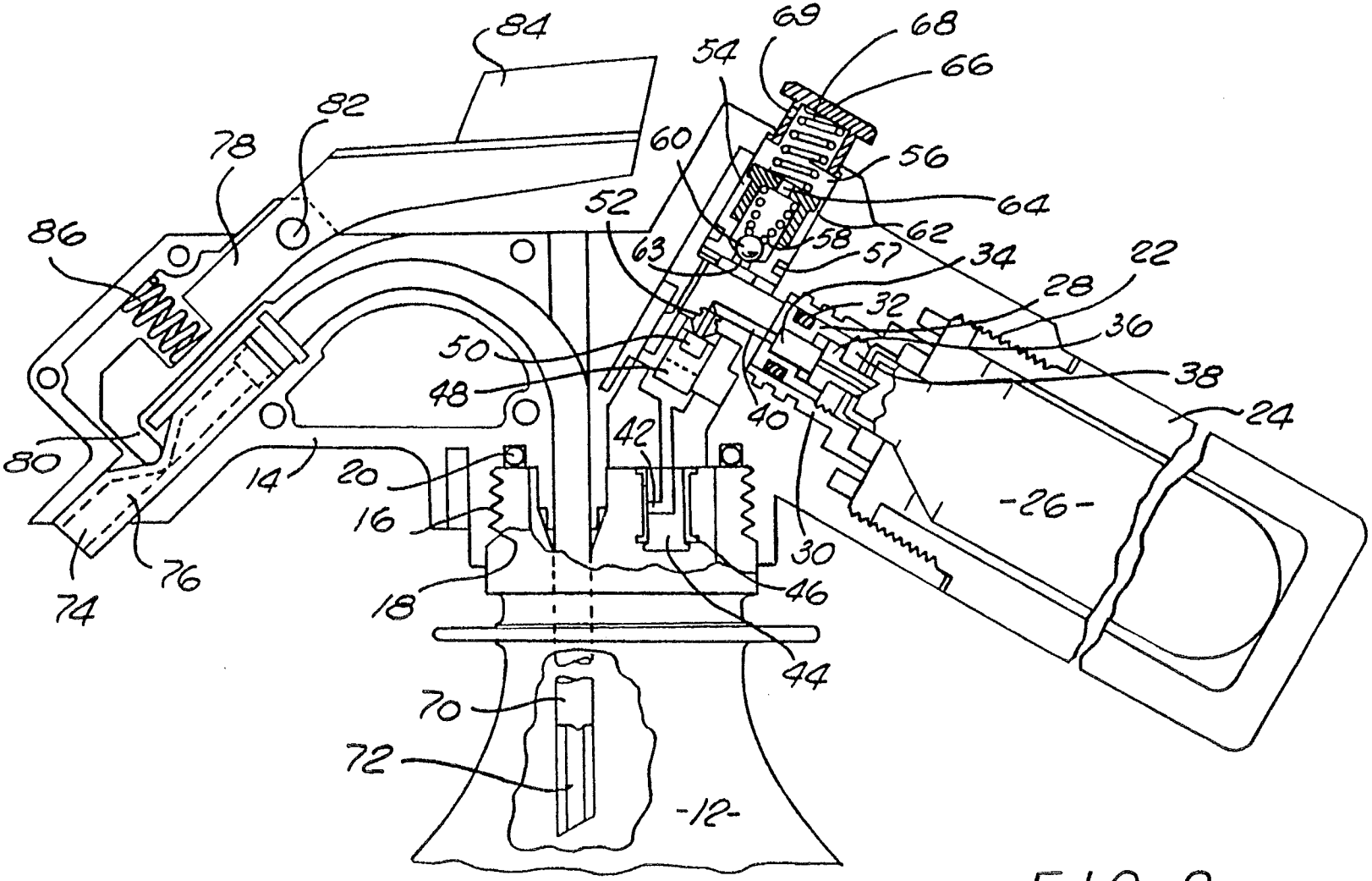
FIG. 2 is a cross-sectional view of the soft drink dispenser of FIG. 1.

As shown in FIGS. 3 and 4, the regulator valve 50 is attached to a valve member 54 located within a pressure relief valve chamber 56 in the housing 14. The valve member 54 is sealed to the housing 14 by O-ring 57 and is adapted to move within chamber 56, so that the valve 50 can move between the closed and opened positions. The valve member 54 is in fluid communication with the beverage container and has an area much larger than the opening of the seat 52. The area ratio is such that the regulator valve 50 is moved to the open position when the pressure of the $CO_2$ creates a force on the valve 50, which is greater than the counteractive force on the valve 50 and valve member 54 that is created by the pressure within the container 12. The valve 50 closes when the force on the valve 50 and valve member 54 is greater than the force on the valve 50 from the $CO_2$ cartridge.

The valve member 54 contains a spring 58 that is coupled to ball valve 60 and captured by cap 62. The ball valve 60 is normally seated within a ball valve opening 63 in the valve member 54. The ball valve opening 63 is in fluid communication with the regulator valve chamber 48. The ball valve 60 provides pressure relief in the event that the regulator valve 50 remains open and $CO_2$ continues to flow into the beverage container 12. The ball valve 60 moves into an open position when the pressure within the container exceeds the spring force of spring 58. The $CO_2$ flows past the ball valve 60 and through a vent port 64 in the cap 62.

The dispenser 10 includes a button 66 which is coupled to the cap 62 by spring 68. Depressing the button 66 compresses the spring 68 and increases the pressure within the beverage container 21. The container pressure can be varied by moving the button 66 relative to the housing 12. Once the regulator valve 50 is opened, by the button 66 and/or the pressure of the $CO_2$ cartridge 26 the valve 50 will remain open until the pressure within the container 12 is great enough to create forces on the valve 50 and valve member 54 which are greater than the combined force of the spring 68 and the force on the regulator valve 50 from the cartridge $CO_2$. The button 66 has a vent port 69 that is in fluid communication with the vent port 64 of cap 62. The port 69 allows $CO_2$ to flow into the ambient when the ball valve 60 moves into the open position.

Extending through the housing is a tube 70 that has an inlet 72 in fluid communication with the beverage container and an outlet 74 that is in fluid communication with the ambient. The tube 70 may include a flexible hose 76 that is coupled to a lever valve 78. The lever valve 78 has a nose portion 80 which can collapse the flexible hose 76 and prevent the beverage from flowing through the tube. The lever 78 pivots about pin 82 and can rotate between an opened position and the closed position. The user can rotate the lever 78 by pushing handle 84. A lever spring 86 is coupled to the lever valve 78 to bias the valve 78 into the closed position. Soda can be dispensed from the beverage container by pushing the handle 84 and rotating the lever 78 into the open position. The pressure within the container 12 causes the soft drink to flow out of the tube 70 when the lever 78 is in the open position.

In operation, the dispenser 10 is screwed onto the container 12 and the $CO_2$ cartridge 26 is attached to the housing 14. If the pressure of the container is such that the force on the valve member 54 is smaller than the force on the regulator valve 50 from the cartridge $CO_2$, the pressure of the $CO_2$ cartridge 26 opens the valve 50 and $CO_2$ flows into the container 12. The valve 50 remains open until the force on the valve member 54 exceeds the counteracting force on the valve 50. Once the container 12 is pressurized, the user can remove the beverage by rotating the lever valve 78 into the open position. Removing soda, reduces the pressure within the container 12 and opens the regulator valve 50 for another charge of $CO_2$.

It may be desirable to increase the amount of $CO_2$ that is introduced to the container. For example, it may be desirable to carbonate an uncarbonated soft drink. The additional carbonation may require an increase in the $CO_2$ pressure provided to the container. The container $CO_2$ pressure can be increased by depressing the button 66. The regulator valve 50 will remain open until the force on the valve member 54 overcomes the cartridge $CO_2$ pressure on the valve 50 and the force of the spring 68. The pressure can be varied by varying the amount of button movement. What is thus provided is a dispenser which automatically maintains the carbonation of a soft drink and allows the user vary the carbonation pressure of the beverage.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A dispenser that dispenses fluid from a container, comprising:

a housing with an opening, said housing being adapted to be coupled to the container;

a cartridge coupled to said housing, said cartridge containing a pressurized gas;

a valve having a first area in fluid communication with said cartridge, said valve being adapted to move between a closed position and an open position such that said valve allows said gas to flow through said housing opening and into the container when in the open position and prevents said gas flow when in the closed position;

a valve housing that is connected to said valve and has a second area greater than said first area of said valve and being in fluid communication with the container, said valve housing having an inner chamber, a first opening in fluid communication with said inner chamber and a second opening in fluid communication with the container;

a spring coupled to said valve housing;

a button that is coupled to said spring such that said valve is moved to the open position when said button is depressed, said spring provides a regulator which allows said valve to move to the closed position when a gas pressure within the container reaches a predetermined level, said button having an opening that is in fluid communication with said first opening of said valve housing;

a spring biased ball valve that controls a flow of gas through said second opening of said valve housing and provides a pressure relief from the container through said button opening;

a tube that extends through said housing, said tube having an inlet in fluid communication with the container and an outlet that is in fluid communication with an ambient;

a lever valve that controls a flow of fluid through said tube, wherein said lever valve allows fluid to flow out of the container when moved into an open position and prevents fluid from flowing out of the container when moved into a closed position.

* * * * *